US006052852A

United States Patent [19]

Huang

[11] Patent Number: 6,052,852

[45] Date of Patent: Apr. 25, 2000

[54] MATTRESS HAVING MASSAGE EFFECT

[76] Inventor: Chia-Shih Huang, No. 268-5, Ching-Liao, Molin Tsun, Houpi Hsiang, Tainan Hsien, Taiwan

[21] Appl. No.: 09/094,444

[22] Filed: Jun. 10, 1998

[30] Foreign Application Priority Data

Jun. 14, 1997 [TW] Taiwan ..... 86209798

[51] Int. Cl.[7] ..... A47C 17/00

[52] U.S. Cl. ..... 5/693; 5/731; 5/906; 5/933; 5/733; 5/105

[58] Field of Search ..... 5/633, 632, 693, 5/717, 731, 654.1, 906, 933, 733, 734, 105; 601/131, 134; 297/452.1

[56] References Cited

U.S. PATENT DOCUMENTS

| | | | |
|---|---|---|---|
| 4,210,134 | 7/1980 | Okazaki et al. | 128/24.1 |
| 4,286,344 | 9/1981 | Ikeda | 5/717 |
| 4,924,542 | 5/1990 | Yamaguchi | 5/906 |
| 5,035,017 | 7/1991 | Komuro | 5/693 |
| 5,416,936 | 5/1995 | Chan | 5/693 |

*Primary Examiner*—Terry Lee Melius
*Assistant Examiner*—Fredrick Conley
*Attorney, Agent, or Firm*—Raymond Y. Chan; David and Raymond

[57] ABSTRACT

The invention provides a novel mattress having massage effect for being cushioned by a human back, and comprising an upholstered seat, a number of springs, a plurality of magnetic stones and an upholstery covering said upholstered seat; wherein, said upholstered seat is provided an accommodating space therein, a lying surface on the top surface thereof, a peripheral stretcher protruded and extended upwardly and provided on at least one end on the lying surface, and a supporting plane formed at the bottom surface of said upholstered seat, the central part of said supporting plane being slightly protruded downwardly; and wherein, said springs are installed in said accommodating space, every two of said springs are linked together, and directions of compression and stretching of each spring are always perpendicular to the lying surface and the supporting plane; further, said magnetic stones are disposed on the lying surface of said upholstered seat, and each of them has a kneading part on the top periphery thereof. When the human back lies correspondingly upon the top surface of the upholstered seat, through supporting by springs, the plurality of magnetic stones can knead vital points on the back in an optimal direction so that effects of alleviating sore, recovering from fatigue and buffering vital points can be achieved.

10 Claims, 4 Drawing Sheets

MATTRESS HAVING MASSAGE EFFECT

BACKGROUND OF THE INVENTION

1. Field of the Invention

The invention relates to a mattress having massage effect, and in particular, to a mattress for being cushioned beneath a person's back to simultaneously massage and magnetic treat the back so that effects of relieving sore in the back and recovering from fatigue can be achieved.

2. Description of the Prior Art

Sore and aching in the shoulder, the neck, the waist and the back is the most popular and thorniest civilization sickness for the modem people, which causes troublesomeness over 80% of population in the advanced countries. Its impact on individual's health and emotion can be less than that caused by fetal vascular disorder or cancer.

Medical literature reported that, since age of 25 years, an adult will has his spinal stress increased year by year; seating and riding too long, sudden braking or traffic tragedy can give a whiplashing impact on the head and neck; and a fixed load on some part of the body such as even an improper height of pillow, a fixed pose such as raising head to watch television or computer screen for long time, reading book by lying on one's side or hanging down the head too long, can increase the possibility of sore and aching in the shoulder, the neck, the waist and the back.

It is known that the spinal column is the main supporting structure supporting the upper part of human body and problems such as sore, aching and deformation in such a supporting structure can have a great impact on the upright of upper part of human body. One may have an uncomfortable feeling such as sore in the back after standing too long, overfatigue and/or improper exercising. While at this time, massaging and kneading relative areas about the spinal column can generally reduce the uncomfortable feeling, however, due to restriction from the structure of the human body, it is impossible to self-massaging one's own back and usually need otherone's help that involves often pressing sore areas. Such kneading sore areas or stimulating relative vital points or nerve centers in the human body by means of the pressing force from otherone's hands may achieve temporarily effects of recovering from fatigue and relieving sore. Nevertheless, since the back of human body is a broad area, the kneading time has to increase correspondingly which will result in not only side effects such as sore and aching in hands, but also limiting desired effect due to simply pressing and stimulating without buffering and balancing in the vital point or nerve center in the body.

Current commercial vibrating type pillows, in general, relied on vibrating entirely by means of electric power, and therefore, people suffering from sore back place might place them beneath their back to expect an effect of massaging the back through vibrating. Unfortunately, those vibrating pillows can give only rough vibrating effect and can not produce specific kneading stimulation against vital points in the back and the effect of buffering and balancing the magnetic field of such vital points so that its can not give significant benefit. In contrast, current commercial massage chairs can give specifically proper massages with respect to the back, and their kneading force can be controlled as well, however, their high prices and huge sizes limit their practicability.

In view of the above-said disadvantages associated with the use current massage pillows and chairs and problems such as sore and fatigue in hands occurred in the case of relieving sore by aid with otherone's hand, the inventors, based on their abundant experiences and specialized knowledge, develop a novel back mattress for cushioning beneath the back and at the same time, kneading relative vital points in the back so that users suffering from sore in the back and fatigue can further enjoy, without the need from otherone's aids, a magnetic treating effect such as buffering vital points by means of magnetic treating stones provided on said novel mattress so as to achieve thoroughly the object of relieving sore and recovering from fatigue.

SUMMARY OF THE INVENTION

Accordingly, the object of the invention is to provide a novel mattress for massaging the back of human body, said novel mattress can be used conveniently by a person suffering from sore in the back to achieve effects of treating sore, recovering from fatigue, preventing from humpback and buffering vital points in the back; and said novel mattress is characterized in that it comprises an upholstered seat, having a plurality of magnetic treating stones provided on the top surface thereof, wherein each of said magnetic treating stones has a massaging part formed on the top periphery thereof and has a central part on its bottom surface protruded downwardly and being capable of properly turning to be a turnable inclined plane; a number of springs moving always upwardly to the bottom inner surface of said upholstered seat; and a soft upholstery provided over said upholstered seat; when someone lies down with his back loaded correspondingly upon the top surface of said upholstered seat, through the elastic supporting of said springs, said magnetic stones can knead vital points on the back in an optimal direction so that effects of alleviating sore, recovering from fatigue and buffering vital points can be achieved simultaneously.

BRIEF DESCRIPTION OF THE DRAWINGS

The invention, as well as its many advantages, may be further understood by the following detailed description and drawings in which.

and wherein

1—the mattress
2—the upholstered seat
3—the first set of springs
4—the second set of springs
5—the magnetic stones
6—the upholstery
7—the back of a human body
20—the inner accommodating space
21—a lying surface
22—peripheral stretcher
23—supporting plane
50—the massage part

DETAILED DESCRIPTION OF THE PREFERRED EMBODIMENT

As described above, the invention relates to a mattress having massage effect, and in particular, to a mattress for being cushioned beneath a person's back to simultaneously massage and magnetic treat the back so that effects of relieving sore in the back and recovering from fatigue can be achieved.

The mattress according to the invention is designed on the basis of the physiological function of the spinal column, whereby, the head, hands and feet of the user fall down naturally, and lies down with his own weight on the upholstered seat of the mattress in a manner that magnetic stones provided and arranged on said seat according to the positions of vital points in the back can press vital points, relax muscles and activate veins during the rocking of magnetic stones in all directions in a natural and easy way, thereby, the spinal column can be relaxed and stretched in reverse direction, tendons tensed on each arthrosis can be stretched, blood flux can be increased, metabolism can be enhanced, as well as the chest can be expandd, muscles and tendons can be stretched, gaps between arthroses can be widened. Moreover, the dislocated or newgrown interspinal protuberance can be restored spontaneously to their normal positions so that sore and aching, the disorder caused by the abnormality, can be relieved as early as possible.

Accordingly, the novel mattress according to the invention is the one that can be cushioned against the human back and massages relative areas thereon, which comprises an upholstered seat, a number of springs, a plurality of magnetic stones and an upholstery; wherein, said upholstered seat is provided an accommodating space therein, a lying surface on the top surface thereof, a peripheral stretcher protruded and extended upwardly and provided on at least one end on the lying surface, and a supporting plane formed at the bottom surface of said upholstered seat, the central part of said supporting plane being protruded downwardly to form a supportable protruding part; wherein, said springs were installed in said accommodating space, every two of said springs are linked together, and directions of compression and stretching of each spring are constantly perpendicular to the lying surface and the supporting plane; further, said magnetic stones are disposed on the lying surface of said upholstered seat, and each of them has a kneading part on the top periphery thereof; and said upholstery covers said upholstered seat in a manner that said magnetic stones are disposed between said upholstery and said upholstered seat.

Figure 1:
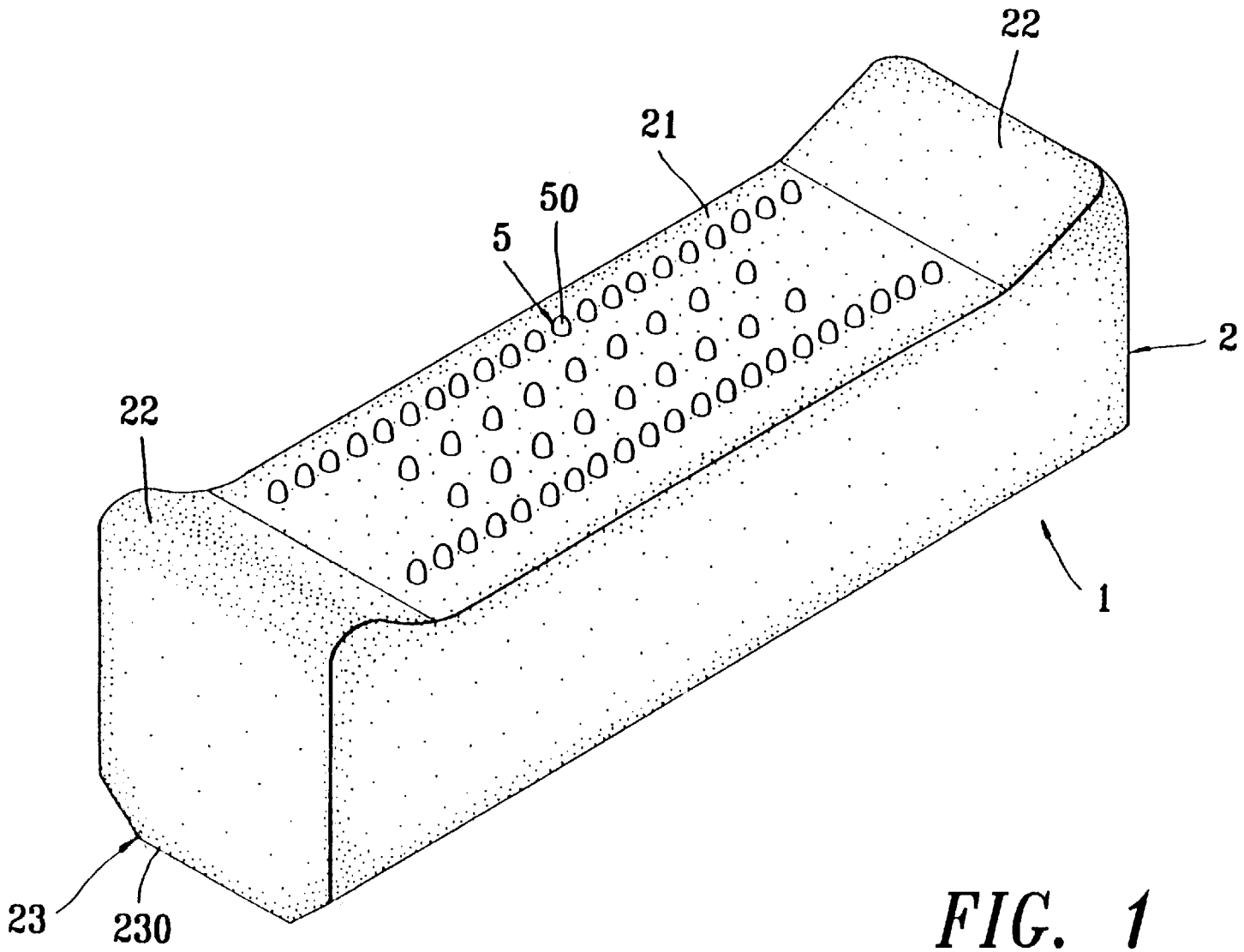
FIG. 1 shows a three-dimensional view of a preferred embodiment according to the invention before providing the upholstery on the upholstered seat.
Figure 2:
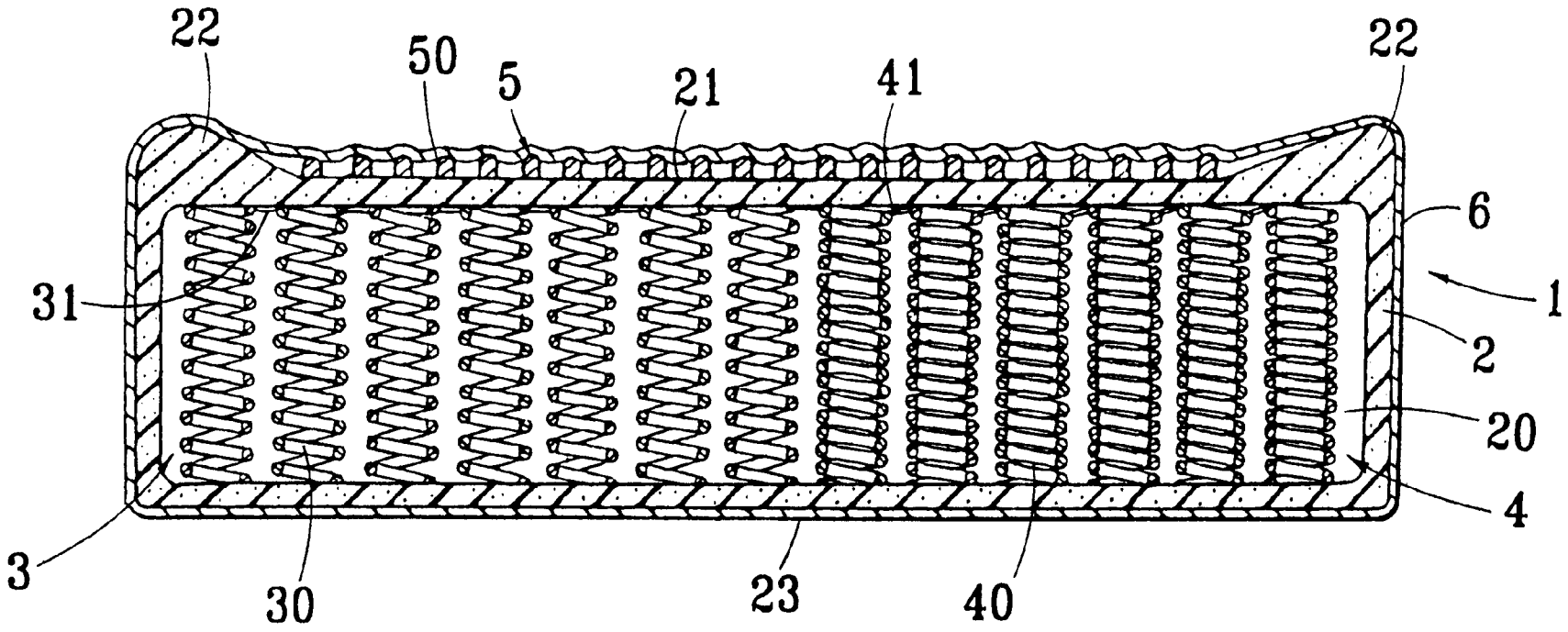
FIG. 2 shows a schematic perspective side view of a preferred embodiment according to the invention.
Figure 3:
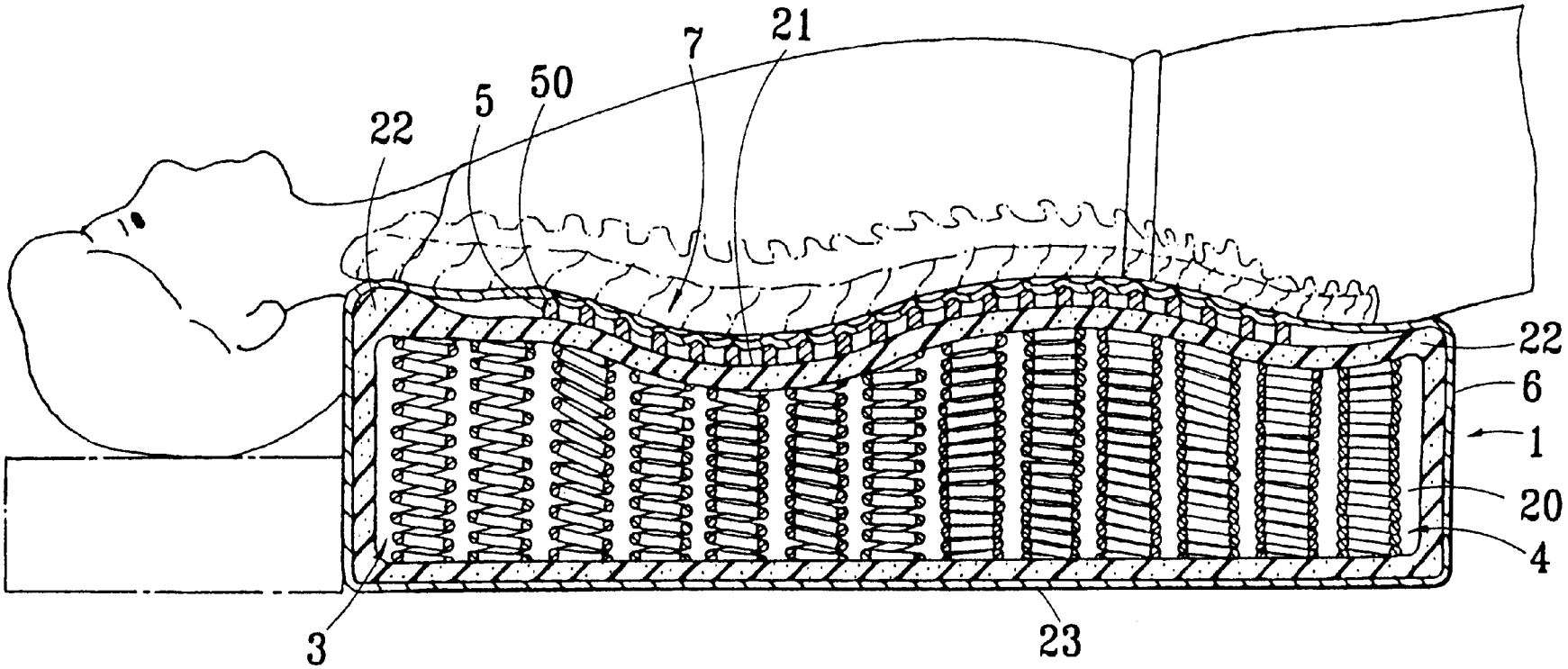
FIG. 3 is a schematic side view showing the use of a preferred embodiment according to the invention.

Now, referring to FIGS. 1 and 2, a preferred embodiment of the invention comprises a mattress 1 having massaging effect, which includes an upholstered seat 2, a first set of springs 3, a second set of springs 4, a plurality of magnetic stones, and an upholstery 6; wherein, said upholstered seat 2 is made of materials having appropriate elasticity, such as a sponge, and has an accommodating space 20 therein. The top surface of said upholstered seat 2 is a flat lying surface 21 for being lied correspondingly by a human back 7 (as shown in FIG. 3), so that its dimension can be designed as, for example, in a length of about 72 cm and a width of about 15 cm. In practice, it can be made, of course, into various sizes such as large, middle or small, for used by people having different sizes. On the front and rear ends of said lying surface 21, there are peripheral stretchers 22 protruded and extended upwardly for stopping the neck and the end of the spinal column from being slipping off. Further, a supporting plane 23 is formed at the bottom surface of said upholstered seat 2, and the central part of said supporting plane 23 protrudes downwardly to form a protruding part 230 having a flat bottom.

The first set of springs 3 is fixed in the front half of the accommodating space 20 of the upholstered seat 2 and are constructed by arranging several first springs 30 having equal elasticity. Each of said first spring 30 is fixed within said accommodating space 20 so that directions of compression and stretching of each first spring 30 are always perpendicular to the above-said lying surface 21 and the supporting plane 23, and top peripheries of every two of the first springs 30 are engaged together by means of a linking element 31.

The second set of springs 4 is fixed in the rear half of the accommodating space 20 of the upholstered seat 2 and are constructed by arranging several second springs 40 having equal elasticity. The height of each second spring 40 is the same as the first spring 30, and the elasticity of each second spring 40 is greater than that of the first spring 30, that is, compared with the first spring 30, the second spring 40 is more elastic and less compressible. Similarly, the top and bottom ends of each of said second spring 40 are fixed within said accommodating space 20 so that directions of compression and stretching of each second spring 40 are always perpendicular to the above-said lying surface 21 and the supporting plane 23, and top peripheries of every two of the second springs 40 are engaged together by means of a linking element 41.

The magnetic stones 5, which are medical magnetic stones having strong magnetic wave, are disposed uniformly on the lying surface 21 of the upholstered seat 2, which, in this embodiment of the invention, are arranged into four rows, and each magnetic stone 5 tapered upwardly to form a kneading part at the top periphery thereof.

The upholstery 6 is made of soft materials such as cloth and covers the outer surface of the upholstered seat 2 with the magnetic stones 5 disposed therebetween.

Now, referring to FIGS. 2 and 3, which show the use of the above-said mattress according to a preferred embodiment of the invention, when used, the mattress 1 is placed on a bed in such a way that the supporting plane 23 of the mattress 1 contacts envenly with the bed, and the user can then lie down with his back 7 upon the lying surface 21 at the middle portion of the upholstery 6 in a manner that the peripheral stretchers 22 at the front and rear ends of the mattress 1 can block the neck and the end of the spinal column, respectively. Here, through the weight of the body, the first and second sets of springs 3 and 4 fixed within the accommodating space 20 are compressed downwardly upon lying on the mattress 1, and thereby, resulted into a deformed state shown in FIG. 3, where the head will bend downwardly. In order to operate more comfortably, in an embodiment of the invention, a pillow for backing by the head can be disposed at a lower place corresponding to the position of the head. At this circumstance, by means of different elasticity between the first and second sets of springs 3 and 4, the lying surface 21 of the upholstered seat 2 can fit correspondingly against the radius of curvature of the back 7 so that supporting forces reached at various area of the back 7 are essentially the same. Further, under the pressing force exerted by the body, the kneading part 50 of the magnetic stone 5 can apply relatively an upward force against the back 7 so as to achieve a massage effect. At the same time, the user can perform a motion of rocking left and right by means of the protruding part 230 designed on the supporting plane 23 such that kneading parts 50 of magnetic stones 5 can knead more uniformly the whole back 7 as well as can find out an optimal and most comfortable mode for kneading vital points on the back 7. Moreover, during massaging by using the mattress of the invention, magnetic field emitted by the magnetic stone 2 can activate and open cells at the vital point and can condition magnetic fields associated with relative area so that the effect of relaxing vital points can be increased. As a result, by carrying out synchronously both of the above-described kneading and magnetic treating, not only sore can be relieved and fatigue can be recovered, but also effects of regulating blood pressure, thrombolysis, and buffering and balancing of muscles, tendons and nerves can be obtained.

In addition, since the mattress of the invention is designed with a width of about 15 cm, when the back 7 lies down, shoulders will stretch out of the mattress 1 to let both hands fall naturally which contributes the expanding of the chest so that an effect of expanding the chest can be achieved.

As described above, the mattress of the invention comprises of providing, firstly, two sets of springs each having different elasticity to fit the radius of curvature of the human back so that the lying pressure can be uniform; next, the peripheral stretcher for blocking from slipping and the design of protruding part on the supporting plane to prevent the back from slipping out of the mattress; and, further, a plurality of magnetic stones whose design can obtain effects of massaging and magnetic treating synchronously. Accordingly, the mattress of the invention can provide uses a convenient self-massaging application to avoid disadvantages occurred in the case of being massaged by otherone. Also, since buffering and balancing of magnetic fields is undergoing at the same time when the mattress of the invention is used for massaging, recovering from fatigue and relieving of sore can be done securely, significant treating effect on muscles and veins can be achieved and problems such as deformation of the spinal column can be prevented. Therefore, the mattress of the invention is indeed a practical massaging tool.

Figure 4:
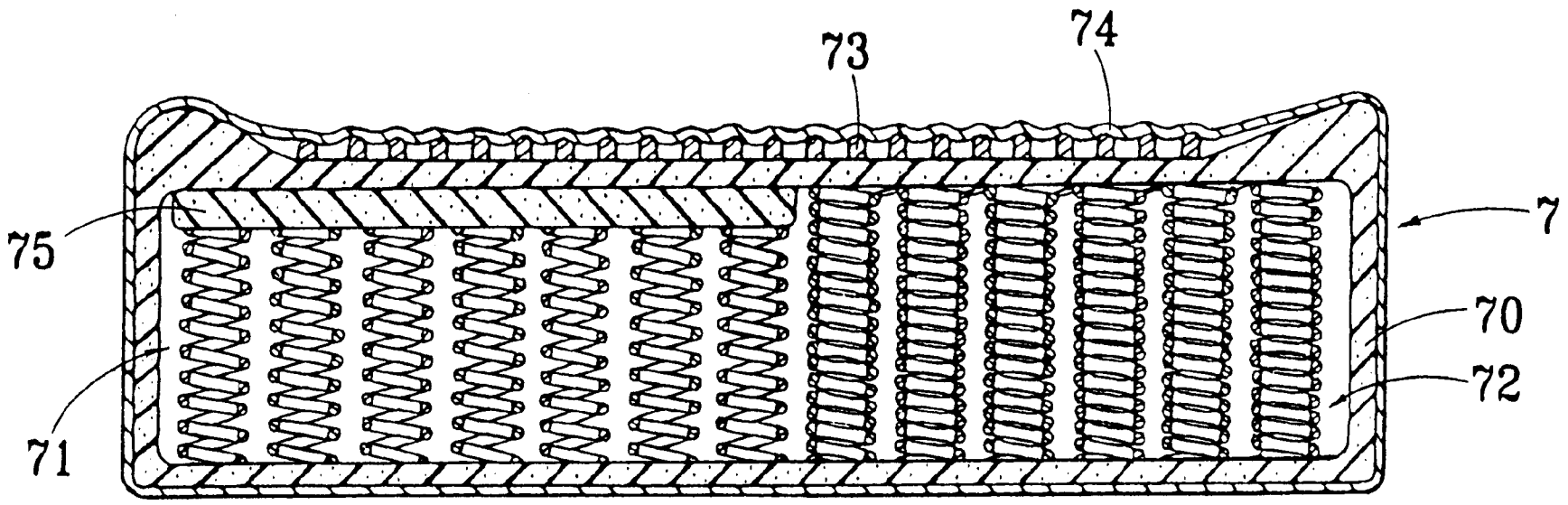
FIG. 4 shows a schematic perspective side view of another preferred embodiment according to the invention.

Now, referring to FIG. 4, another embodiment of the mattress 7 according to the invention comprises likely an upholstered seat 70, a first set of springs 71, a second set of springs 72, a plurality of magnetic stones 73 and an upholstery 74, which have structures essentially same as described in the above-said embodiment, and thereofore, description thereof is omitted here. Differences with respect to the above-said embodiment include: the height of the first set of springs 71 is less than that of the second set of springs 72, and a cushion 75 having a elasticity less than that of the second set of springs 72 is provided on the top periphery of the first set of springs 71, wherein, by means of the cushion 75, the top surface of the upholstered seat 70 can form a flat plane having a level of height before applying a pressure thereon.

In summary, the mattress of the invention can, through the combination of the upholstered seat, the first and second sets of springs, and a plurality of magnetic stones, allow the user self-massaging and magnetically treating his back so as to achieve conveniently effects of treating sore and aching, recovering from fatigue, preventing from being humpback and expanding the chest. Accordingly, disadvantages associated with massaging by other persons can be avoided and effects that can not be achieved by using conventional massage tools can be effected thereby. Therefore, the mattress of the invention is truly a practical product. Furthermore, the entire structure and spatial morphology of the combination of the mattress according to the invention have not been disclosed in analogous products so that it is a novel product.

Many changes and modifications in the above described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A human back mattress for placing on a bed to additionally support a back of a user while limbs of the user remaining lying on the bed, wherein said mattress comprises:

an upholstered seat made of elastic material and defined an accommodating space therein, wherein said accommodating space divides into a front half and a rear half, said upholstered seat having a top surface forming a flat lying surface and a bottom surface forming a supporting plane for evenly contracting with the bed when said mattress is placed on the bed, wherein said flat lying surface has a size adapted for merely supporting the back of the user, a front stretcher and a rear stretcher respectively protruded and extended upwardly at a front end and a rear end of said flat laying surface for stopping a neck and an end of a spinal column of the user from being slipping off;

a plurality of magnetic stones, which are disposed on said flat lying surface of said upholstered seat, each having a kneading part on a top periphery thereof;

an upholstery covering said upholstered seat in a manner that said magnetic stones are disposed between said upholstery and said flat lying surface of said upholstered seat;

a first set of springs comprising a plurality of first springs which are uniformly affixed in said front half of said accommodating space of said upholstered seat and arranged to have an equal elasticity, wherein directions of compression and stretching of each of said fist springs are maintained perpendicular to said flat lying surface and said supporting plane, and that top peripheries of every two of said first springs are engaged together by means of a first linking element; and a second set of springs comprising a plurality of second springs which are uniformly affixed in said rear half of said accommodating space of said upholstered seat, wherein each of said second springs is arranged to have a second elasticity greater than said elasticity of said first springs, moreover each of said second springs is more elastic and less compressible in comparison with said first springs, wherein directions of compression and stretching of each of said second springs are maintained perpendicular to said flat lying surface and said supporting plane, and that top peripheries of every two of said second springs are engaged together by means of a second linking element, whereby by means of said different elasticity between said first and second sets of springs, said flat lying surface of said upholstered seat is adapted for fitting correspondingly against a radius of curvature of the back of the user so that supporting forces reached at various area of the back are uniformly the same, moreover under a pressing force exerted by the user, said kneading parts of said magnetic stones apply relatively an upward force against the back of the user to achieve a massage effect.

2. The mattress as recited in claim 1 wherein said first springs and said second springs each has a same height.

3. The mattress as recited in claim 1 further comprising a cushion having an elasticity less that that of said second springs, wherein said cushion is provided on top of said first set of springs and each of said first springs has a same height which is less than that of each of said second springs, wherein by means of said cushion, said flat lying surface of said upholstered seat forms a flat plane having a level of height before applying a pressure thereon.

4. The mattress as recited in claim 2 wherein said mattress has a length of 72 cm and a width of 15 cm.

5. The mattress as recited in claim 3 wherein said mattress has a length of 72 cm and a width of 15 cm.

6. The mattress as recited in claim 1 wherein a central portion of said supporting plane is protruded downwardly to form a protruding part which enables said mattress rocking left and right so that said kneading parts of said magnetic stones knead more uniformly the back of the user.

7. The mattress as recited in claim 2 wherein a central portion of said supporting plane is protruded downwardly to form a protruding part which enables said mattress rocking left and right so that said kneading parts of said magnetic stones knead more uniformly the back of the user.

8. The mattress as recited in claim 3 wherein a central portion of said supporting plane is protruded downwardly to form a protruding part which enables said mattress rocking left and right so that said kneading parts of said magnetic stones knead more uniformly the back of the user.

9. The mattress as recited in claim 4 wherein a central portion of said supporting plane is protruded downwardly to form a protruding part which enables said mattress rocking left and right so that said kneading parts of said magnetic stones knead more uniformly the back of the user.

10. The mattress as recited in claim 5 wherein a central portion of said supporting plane is protruded downwardly to form a protruding part which enables said mattress rocking left and right so that said kneading parts of said magnetic stones knead more uniformly the back of the user.

* * * * *